US007064677B2

(12) United States Patent
Newman

(10) Patent No.: US 7,064,677 B2
(45) **Date of Patent: *Jun. 20, 2006**

(54) METHOD OF MONITORING SERVICE OPERATIONS OF A SERVICE VEHICLE AT A WELL SITE

(75) Inventor: Frederic M Newman, Midland, TX (US)

(73) Assignee: Key Energy Services, Inc., Houston, TX (US)

( * ) Notice: Subject to any disclaimer, the term of this patent is extended or adjusted under 35 U.S.C. 154(b) by 479 days.

This patent is subject to a terminal disclaimer.

(21) Appl. No.: 10/440,633

(22) Filed: May 19, 2003

(65) Prior Publication Data

US 2003/0196798 A1 Oct. 23, 2003

Related U.S. Application Data

(63) Continuation-in-part of application No. 09/945,924, filed on Sep. 5, 2001, now Pat. No. 6,578,634.

(51) Int. Cl.
*G01V 3/00* (2006.01)

(52) U.S. Cl. ..... 340/854.6; 340/870.1; 340/870.11; 166/250.01; 166/275; 73/152.29

(58) Field of Classification Search ..... 340/854.6, 340/870.1, 870.11; 166/250.01, 275, 255.1; 73/152.29; 702/45

See application file for complete search history.

(56) References Cited

U.S. PATENT DOCUMENTS

| | | | | |
|---|---|---|---|---|
| 4,700,142 | A * | 10/1987 | Kuckes | 340/853.5 |
| 4,765,435 | A * | 8/1988 | Reichert | 181/102 |
| 4,884,847 | A * | 12/1989 | Bessinger et al. | 299/1.05 |
| 5,218,301 | A * | 6/1993 | Kuckes | 324/346 |
| 5,298,894 | A * | 3/1994 | Cerny et al. | 340/870.02 |
| 5,438,329 | A * | 8/1995 | Gastouniotis et al. | 340/870.02 |
| 5,617,084 | A * | 4/1997 | Sears | 340/870.02 |
| 6,006,212 | A * | 12/1999 | Schleich et al. | 705/412 |
| 6,021,093 | A * | 2/2000 | Birchak et al. | 367/25 |
| 6,087,965 | A * | 7/2000 | Murphy | 340/991 |
| 6,253,849 | B1 * | 7/2001 | Newman | 166/255.1 |
| 6,377,189 | B1 * | 4/2002 | Newman | 340/854.6 |
| 6,578,634 | B1 * | 6/2003 | Newman | 166/250.01 |
| 6,826,492 | B1 * | 11/2004 | Newman | 702/45 |

* cited by examiner

*Primary Examiner*—Albert K. Wong

(57) ABSTRACT

A method monitors servicing operations of a vehicle capable for example of pumping various fluid treatments down into a well being serviced at a well site. The method records the vehicle's engine speed and the values of one or more service-related variables, such as pressure, temperature, flow rate, and pump strokes per minute. These variables are recorded as a function of the time of day in accordance with when they were sensed, and are associated with a well site identifier to form a data record. Global Positioning System data associated with the service vehicle assists in determining the well site identifier or can constitute the well site identifier. In some embodiments, the data record is communicated over a wireless communication link from a remote well site to a central office.

22 Claims, 10 Drawing Sheets

METHOD OF MONITORING SERVICE OPERATIONS OF A SERVICE VEHICLE AT A WELL SITE

CROSS REFERENCE TO RELATED APPLICATIONS

This application is a continuation-in-part of U.S. patent application Ser. No. 09/945,924, filed Sep. 5, 2001, now U.S. Pat. 6,578,634, which is incorporated herein by reference and to which priority is claimed under 35 U.S.C. § 120.

BACKGROUND OF THE INVENTION

1. Field of the Invention

The invention generally pertains to service vehicles used in performing work at a well site, and more specifically to a method of monitoring the vehicle's service operations.

2. Description of Related Art

After a well is set up and operating to draw petroleum, water, or other fluid up from within the ground, various services are periodically performed to maintain the well in good operating condition. Since wells are often miles apart from each other, such services are usually performed by an appropriately equipped service vehicles, including but not be limited to chemical tank trucks or trailers, cement trucks or trailers, hot-oiler tank trucks or trailers, and portable work-over service rigs having hoists to remove and install well components (e.g., sucker rods, tubing, etc.).

Service vehicles are often owned by independent contractors that well companies (e.g., the well owner or operator) pay to service the wells. Well owners typically have some type of contractual agreement or "master service agreement" with their various contractors. The agreement generally specifies what goods and services are to be provided by the contractor, the corresponding fees, and may even specify other related items such as operating procedures, safety issues, quantity, quality, etc.

Service operations are usually performed at well sites that are remote to the well owner's main office, perhaps hundreds of miles apart. It therefore can be difficult for a well owner to confirm whether a contractor is fully complying with his part of the agreement. Without a company representative at the well site to witness the services being performed, the well owner may have to rely on whatever report or invoice the contractor supplies. This can lead to misunderstandings, false billings, payment delays, suspicions, and disagreements between the contractor and the well owner. To further complicate matters, in a single day, service contractors may do work at different wells for different well owners. Thus, a contractor could mistakenly bill one well owner for work performed on a well of another owner.

SUMMARY OF THE INVENTION

A method monitors servicing operations of a vehicle capable for example of pumping various fluid treatments down into a well being serviced at a well site. The method records the vehicle's engine speed and the values of one or more service-related variables, such as pressure, temperature, flow rate, and pump strokes per minute. These variables are recorded as a function of the time of day in accordance with when they were sensed, and are associated with a well site identifier to form a data record. Global Positioning System data associated with the service vehicle assists in determining the well site identifier or can constitute the well site identifier. In some embodiments, the data record is communicated over a wireless communication link from a remote well site to a central office.

DESCRIPTION OF THE PREFERRED EMBODIMENT

Figure 1:
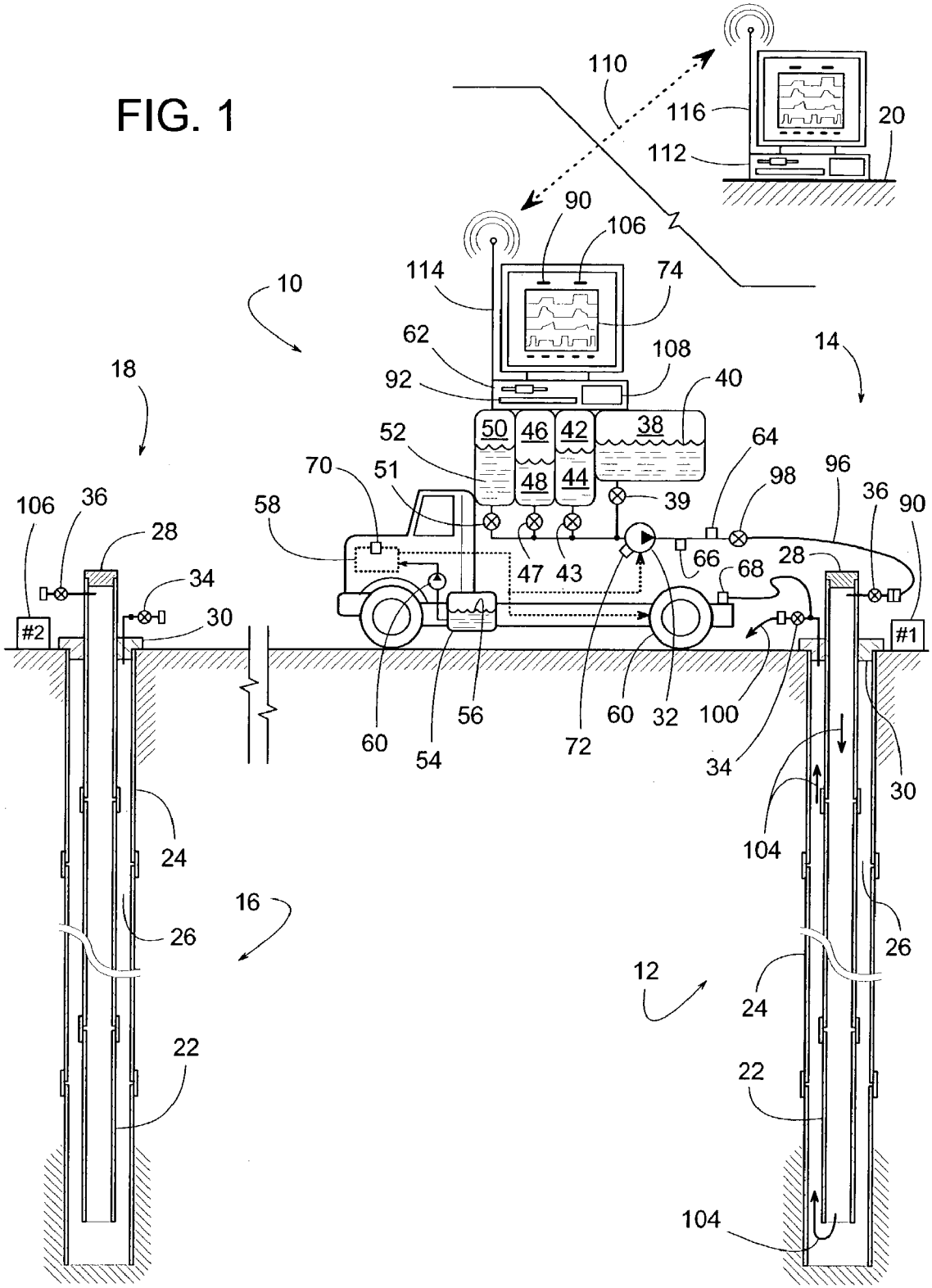
FIG. 1 is a schematic diagram illustrating a method of monitoring a service vehicle's operations at a first well site according to some embodiments of the invention.
Figure 2:
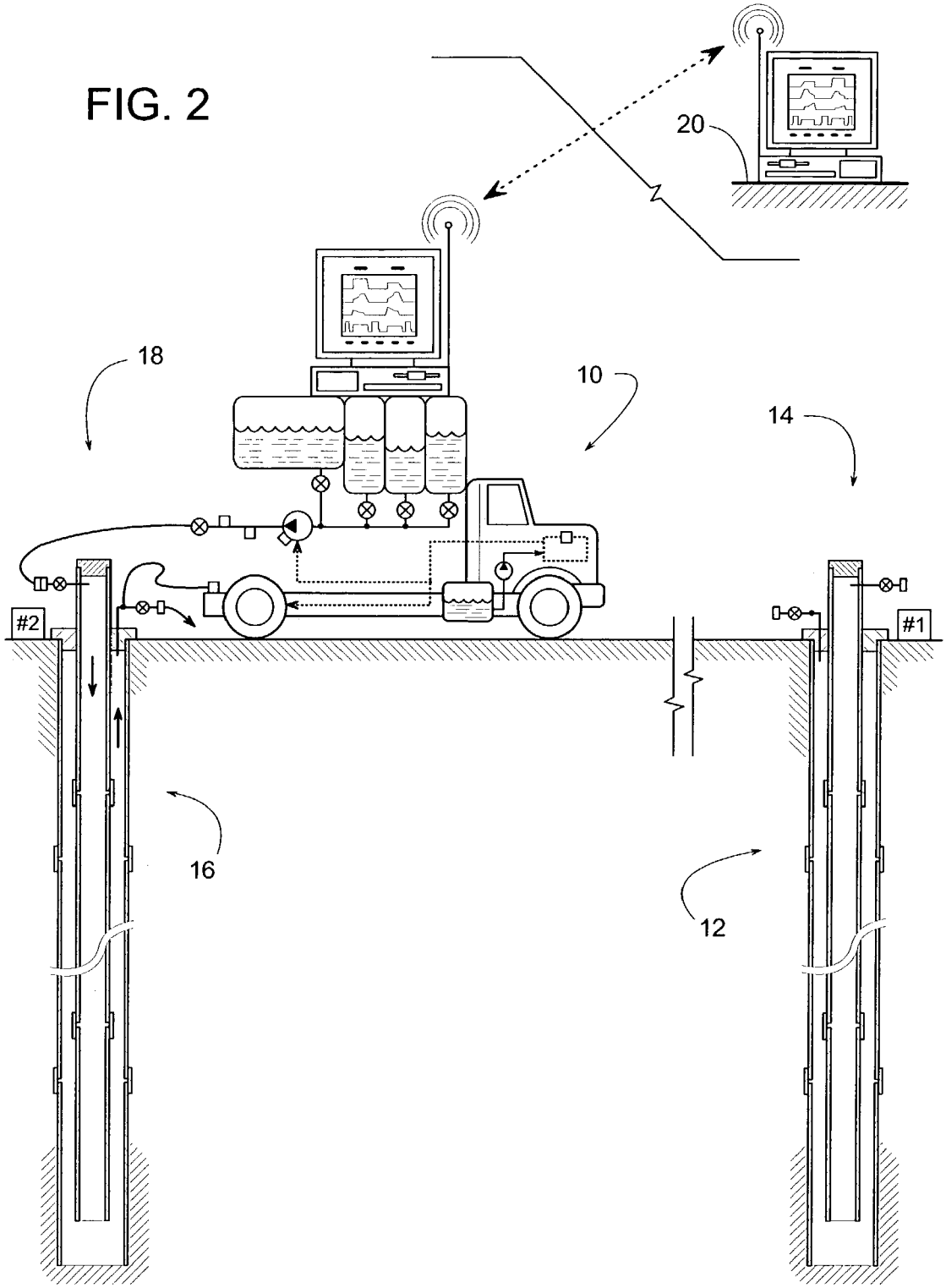
FIG. 2 is similar to FIG. 1, but showing the service vehicle as a pumping truck pumping fluid at a second well site.

FIGS. 1 and 2 illustrate one embodiment of the present invention and disclose a service vehicle 10 for servicing a first well 12 at a first well site 14 and a second well 16 at a second well site 18. The two well sites 14 and 18 may be quite remote from one another (e.g., miles apart) and may both be miles apart from a main office 20. Wells 12 and 16 each include a string of tubing 22 disposed within a string of casing 24. Under normal operation, petroleum, water, gas or other ground-source fluid passes through openings in casing 24 to enter an annulus 26 between the inner wall of casing 24 and the outer wall of tubing 22. From annulus 26, the fluid is then pumped or otherwise forced upward through the interior of tubing 22, so the fluid can be extracted at ground level for later use or processing.

As shown in the present drawings, the service vehicle 10 is shown as a pump truck used for pumping fluids into the well, and may represent any fluid-pumping vehicle, examples of which include, but are not limited to, a tanker truck, a fluid pumping truck, a kill truck, a chemical truck, a treating truck, and a hot oil truck. However, it should be understood that while the operations of a pump truck are illustrated in detail in this application so as to clarify the nature of the present invention, service vehicle 10 can be any appropriately equipped service vehicle. Other examples include, but are not limited to, chemical tank trucks or trailers, cement trucks or trailers, hot-oiler tank trucks or trailers, or portable work-over service rigs having hoists to remove and install well components. All of these examples of service vehicles and similar vehicles are generically represented by service vehicle 10. The operations of these various service vehicles are well known to those of skill in the art of well servicing operations.

In one embodiment in which a pump truck is used to facilitate certain operations of servicing a well, an end cap 28 may be temporarily installed at the upper end of tubing 22. With tubing 22 capped and an annular seal 30 installed between tubing 22 and casing 24, a servicing fluid can be forced through annulus 26 and/or tubing 22. A pump 32 on vehicle 10 can force the servicing fluid into the well via an annulus valve 34 which communicates with annulus 26 or a tubing valve 36 which communicates with tubing 22.

Vehicle 10 includes at least one tank for holding a fluid and at least one pump for pumping the fluid. Examples of the fluid being pumped include, but are not limited to, water (pure or with some additives), hot oil, fuel to power vehicle 10 (e.g., gasoline or diesel fuel), a scale inhibitor (e.g., DynoChem 1100 by DynoChem of Midland, Tex.), an emulsion breaker (e.g., DynoChem 5400 by DynoChem), a bactericide (e.g., DynoCide #4 by DynoChem), a paraffin dispersal (e.g., CynoChem 7498 by DynoChem), and an antifoaming agent (e.g., DynoChem 4690 by DynoChem). In some embodiments, vehicle 10 includes a first tank 38 for water 40, a second tank 42 for a paraffin dispersal 44, a third tank 46 for a scale inhibitor 48, a fourth tank 50 for a bactericide 52, and a fuel tank 54 for fuel 56 to power an engine 58 of vehicle 10. Engine 58 is coupled to power drive wheels 60 of vehicle 10 and is further coupled to drive pump 32, which is adapted to selectively pump fluids 40, 44, 48 and 52 into a well. Valves 39, 43, 47 and 51 allow pump 32 to selectively draw fluid from tanks 38, 42, 46 and 50 respectively. A fuel pump 61 pumps fuel 56 from tank 54 to engine 58, which allows vehicle 10 to drive between well sites.

Vehicle 10 carries an electrical data storage device, such as a data collector 62 that receives input signals from various feedback devices for monitoring the operations of vehicle 10. Data collector 62 is schematically illustrated to include any device for collecting, manipulating, converting, transferring and/or storing digital data. Examples of data collector 62 include, but are not limited to, a personal computer, a desktop computer, a laptop, notebook, a PLC (programmable logic controller), a data logger, etc. The vehicle 10 further includes various feedback devices for sensing variables associated with the fluid being pumped, including, but not limited to, pressure, temperature and flow rate. Such feedback devices for a pump truck include, but are not limited to, a pump discharge pressure sensor 64, a pump discharge flow meter 66, an annulus pressure sensor 68, a tachometer 70 (i.e., a device that provides a signal useful in determining a relative speed of engine 58), and a counter 72 to monitor the strokes per minute of a reciprocating pump, such as pump 32. Of course, if a different service vehicle is used, the types of feedback devices can be different from the ones listed above. It should be noted that vehicle 10 could have more or less than the feedback devices mentioned above and still remain within the scope of the invention. For example, counter 72 and flow meter 66 both can provide data collector 62 with an indication of the flow rate of pump 32, which may be all that is desirable to monitor. Also, additional feedback devices, such as limit switches, may be used to sense the open/closed position of valves 39, 43, 47 and 51 and provide data collector 62 with an indication of which fluid pump 32 is pumping.

In operation, vehicle 10 may travel from a contractor's home base to well 12 to pump water 40 from tank 38 down into tubing 22 and back up through annulus 26. Such an operation is often referred to as "killing the well" and is used for preparing the well for further maintenance work and/or for checking the well for leaks or flow blockages. Later in the day, vehicle 10 may travel to well 16 to perform a similar killing operation. At the end of the day, vehicle 10 returns to the contractor's home base. With data collector 62 collecting data from feedback devices 64, 66, 68, 70 and 72 and/or other devices, the vehicle's sequence of operations for the day is recorded as a stored data record 74. The stored data record 74 comprises various digital values representative of the variable associated with the fluid being pumped, the time of day that the fluid is being pumped, the speed of engine 58, and a well site identifier that indicates at which well vehicle 10 was operating.

Figure 3:
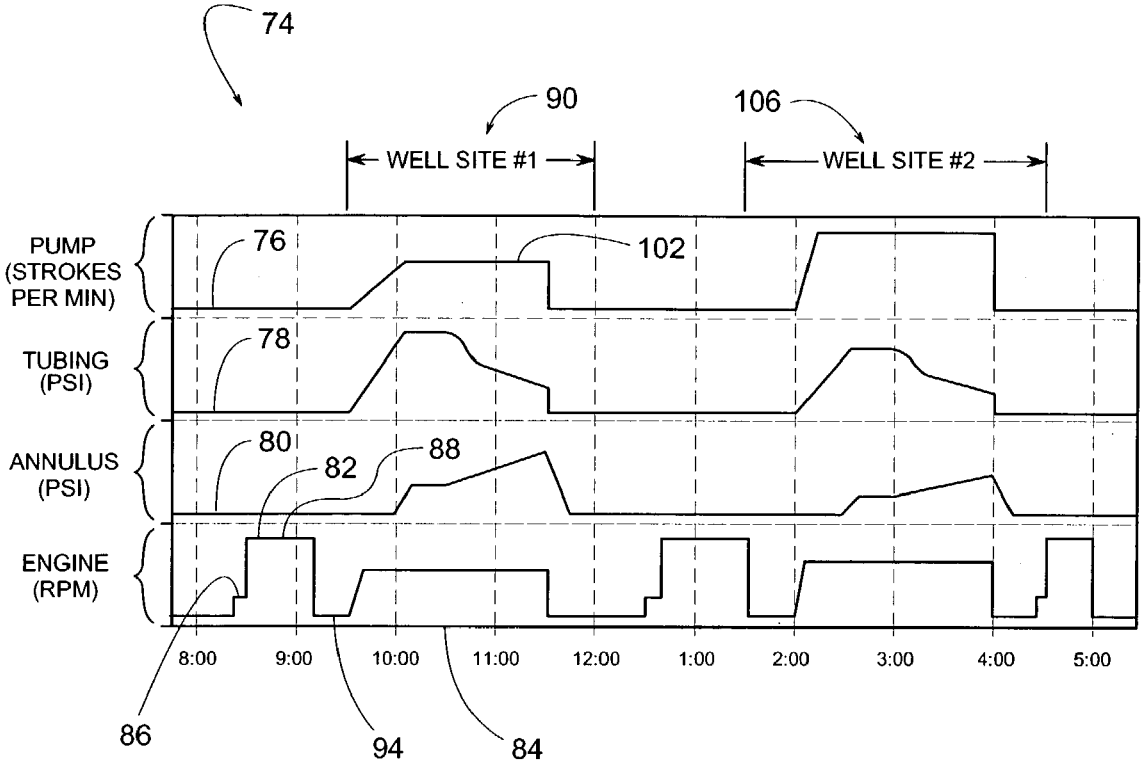
FIG. 3 is a stored data record of digital values that reflect the pumping operations of a vehicle at multiple well sites.

The stored data record 74 can be displayed in various formats such as a tabulation of digital values and/or a corresponding graphical format, as shown in FIG. 3. The graphical format of data record 74 provides plots of certain key variables as a function of the time of day that the variables were sampled. In FIG. 3, for example, the plotted variables are pump strokes per minutes 76 as sensed by counter 72, tubing pressure 78 as sensed by pressure sensor 64, annulus pressure 80 as sensed by pressure sensor 68, and RPM 82 (revolutions per minute) of engine 58 as measured by tachometer 70. Variables 76, 78, 80 and 82 are plotted with reference to a common X-axis 84 representing the time of day. The displayed plots and values of FIG. 3 comprise one example of a stored data record 74 that is stored by data collector 62. All the values of stored data record 74 are preferably digital for ease of manipulation and storage by data collector 62. Although input from feedback devices 64, 66, 68, 70 and 72 may originate as analog signals, a conventional A/D converter (in the form of a separate circuit or incorporated into data collector 62) converts the signals to digital values readily handled and stored by data collector 62.

It is important that the data record 74 be associated with a well site identifier. The well site identifier for a specific well may be the well's APIN (American Petroleum Institute Number), or some other textual identifier, such as, for example, "WELL SITE #1," as shown in FIG. 3. The term "well identifier" as used herein represents any value or feature that can be referenced to distinguish one well from another. The well identifiers may be embodied in bar code labels (as commonly used on retail merchandise), magnetic or electromagnetic strips (similar to a common credit card or some building access security badges), integrated circuit chips (similar to an electromagnetic implant used for animal identification), or in memory such as a hard drive of a computer, a floppy disc, a CD (compact disk), a ZIP drive/cartridge, an electronic chip such as RAM, EPROM, or EEPROM and variations thereof, or magnetic tape. Regardless of the means used to embody the well identifiers, each well will have its well identifier present at the well site, and this well identifier can be input by various means (e.g., manually by keyboard, by scanning the bar code at the well, by uploading information transmitted from the integrated circuit, etc.) to the data collector 62 so that it can become a part of the data record 74.

Finally, the well site identifier can constitute a global positioning signal (GPS) reading at the website. For instance, the vehicle 10 can be fitted with a GPS device 200 to determine the exact location of the vehicle 10. Data from the GPS device 200 can then entered into data collector 62 so that the vehicle's position becomes part of the data record 74. Such data can be taken only when the vehicle 10 is present at a well site being serviced, or can always be on, such that the location of the vehicle is always known even as it drives from site to site. The GPS device 200 can communicate with the data collector 62 by way of a direct connection or automatic uplink, or its data can be manually entered by the vehicle's operator. The term "GPS device" refers to any positioning system that includes a receiver whose general location or global coordinates are determined based on communication between the receiver (e.g., 200) and one or more known references, such as satellites, antennas, transmitters, or other predetermined references (not shown). One specific example of a GPS device is a model S-Vee-8 by Trimble Navigation, Ltd. of Sunnyvale, Calif.

Because each well site occupies a unique position on the face of the earth, the GPS data leaves little doubt as to what well site the vehicle 10 is servicing. Moreover, the GPS data (plus or minus 50 meters to allow for some variance in the position of the vehicle 10 at the well site) can be pre-correlated to a well site identifier which is better understood by the well owner or servicing crew. For example, if it is known that XYZ, Inc.'s has three wells with owner well site identifiers "0130," "0245," and "3546," and it is known that these three wells are respectively located at exactly 31° 48' N./98° 57' W. 30° 40' N./96° 33' W., and 27° 46' N./97° 30' W., a look up table in (or in communication with) data collector 62 can be used to covert the longitude/latitude data from the GPS device 200 to the owner well site identifiers, with these well site identifiers stored in the data record 74. Alternatively, the raw longitude/latitude data from the GPS device 200 itself can be used as the well site identifier and stored in the data record 74, or both the raw GPS data and the looked-up owner well site identifiers can be stored. In short, "well site identifier" can constitute both the raw GPS data and/or better-understood and more traditional well site identifiers.

For the example shown in FIG. 3, the vehicle's engine was started just before 8:30 am and left idling briefly, as indicated by numeral 86. An elevated RPM reading 88 represents vehicle 10 traveling from the contractor's home base and arriving at first well 12 at about 9:10 am. Once at well 12, a first well site identifier 90 that identifies the well by name, description, or location is entered into data collector 62 by way of a key board 92 or by some other data input method such as those described above. Numeral 94 indicates engine 58 is idle between 9:10 and 9:30 am, during which time workers are apparently setting up to kill well 12. Setup may involve connecting a hose 96 from a pump discharge valve 98 on vehicle 10 to tubing valve 36 on well 12. Annulus valve 34 may be partially opened to relieve fluid pressure building up due to pump 32 forcing water 40 into tubing 22, which forces fluid upward through annulus 26. Discharge 100 through valve 34 is preferable directed to a holding tank (not shown).

At 9:30 am, engine 58 begins driving pump 32, as indicated by the engine RPM 82, and eventually pump strokes/min 76, tubing pressure 78, and annulus pressure 80 all begin to increase. Numeral 102 indicates a generally constant flow rate between 10:00 am and 11:30 am. Arrows 104 of FIG. 1 indicate the general direction of fluid flow through tubing 22 and annulus 26 during the kill procedure. The pressure in tubing 22 peaks shortly after 10:00 am, and the pressure in annulus 26 peaks just before pump 32 is turned off at 11:30 am. The pressure of annulus 26 increases while the pressure in tubing 22 decreases, which is due to oil originally in tubing 22 being displaced by the heavier water 40 from tank 38. When the pumping ceases at 11:30 am, tubing pressure 78 drops off almost immediately; however, annulus pressure 80 decreases more slowly, because the standing head of water in tubing 22 continues to apply pressure to fluid in annulus 26 which now contains a higher percentage of relatively light oil. From 11:30 am to 12:30 am, vehicle 10 is inactive, which can mean the crew working on well 12 is taking a lunch break or preparing to leave well site 14.

At 12:30 am, the RPM of engine 58 increases with no sign of any pumping, which indicates that vehicle 10 is traveling to another well site. At 1:30 pm, a second well site identifier 106 is manually or automatically entered into the data collector 62 to indicate they have arrived at well site 18. Equipment setup occurs between 1:30 pm and 2:00 pm, and pumping runs from 2:00 pm to 4:00 pm. Plots 76, 78, 80 and 82 show that the pumping process at well site 18 is similar to that at well site 14. At well site 18, however, the pump strokes/min 76 is higher, while the tubing pressure 78 and the annulus pressure 80 is lower than what was experienced at well site 14. This could indicate that well 12 is deeper and/or provides more flow resistance than well 16. As the service crew prepares to leave well site 18, the plots indicate a period of equipment inactivity between 4:00 pm and 4:30 pm. At 4:30 pm, the engine RPM curve 82 indicates a short period of engine idling before vehicle 10 travels about 30 minutes back to the contractor's home base for an arrival time of about 5:00 pm.

By knowing the displacement of pump 32, its strokes/min, and how long pump 32 was running at each well, the contractor can now determine the quantity of water that was pumped into wells 12 and 16 and can charge the well owners accordingly.

In some embodiments of the invention, data collector 62 includes communication equipment 108 (e.g., a modem, cell phone, etc.). Communication equipment 108 enables the stored data record 74 to be transmitted via the Internet (or other communication system) over a wireless communication link 110 (e.g., airwaves, satellite, etc.) to a computer 112 at a location remote relative to well sites 14 and 18. Computer 112 may be at the main office of the well owner or at the contractor's home base, so the owner or contractor can monitor operations at the well site even though they may be miles from the site. The term "wireless communication link" refers to data being transmitted over a certain distance through a medium of air and/or space rather than through wires. Wireless communication link 110 is schematically illustrated to represent a wide variety of systems that are well known to those skilled in the art of wireless communication. For example, if the data collector 62 is associated with a computer with modem and an antenna 114, a similar computer 112 having a similar modem and antenna 116 can receive data record 74, which as noted can be transferred over the Internet with the assistance of a wireless communication link. Data record 74 can assume any of a variety of common formats including, but not limited to HTML, e-mail, and various other file formats that may depend on the particular software being used by the respective computers.

Figure 4:
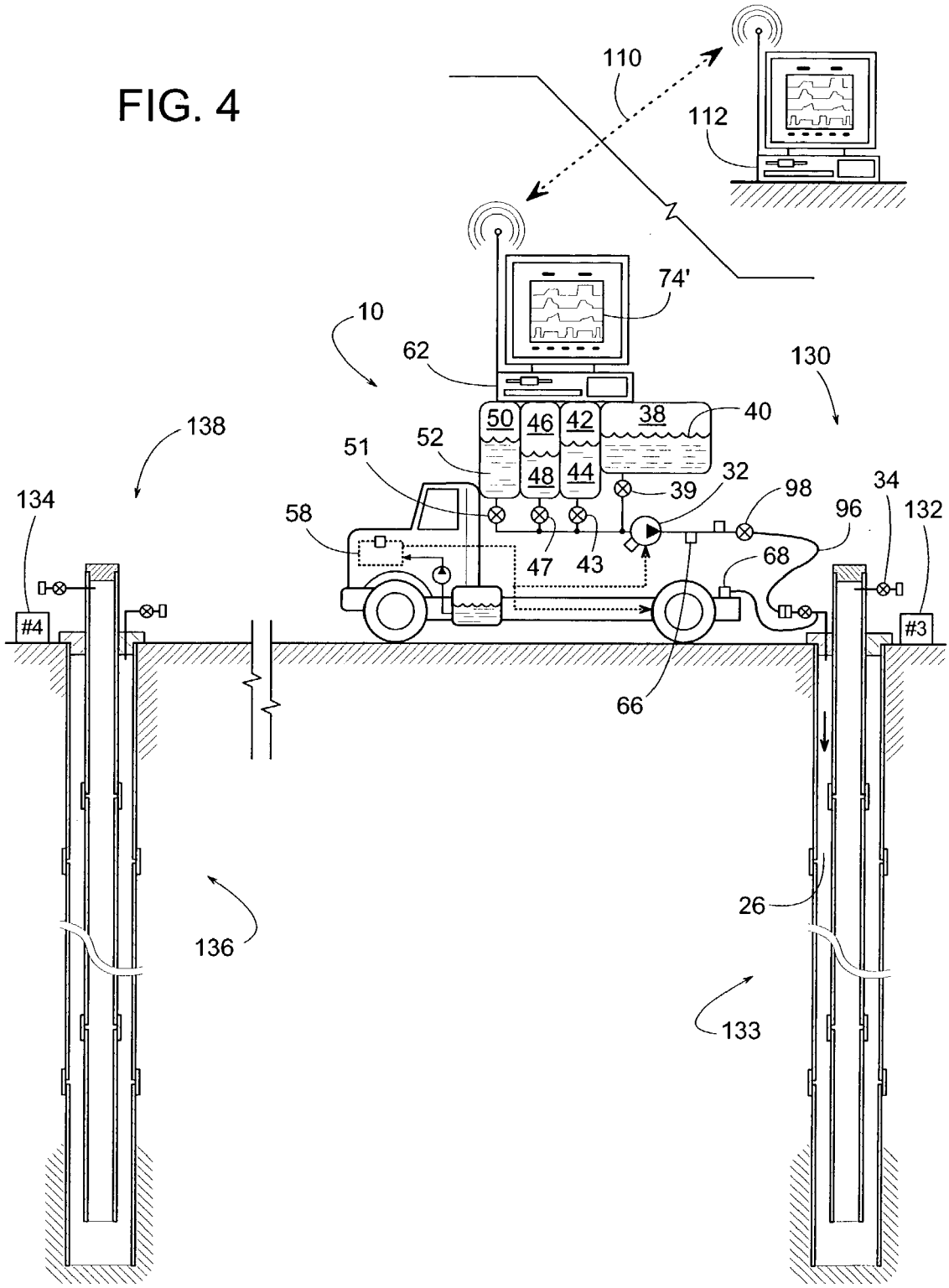
FIG. 4 is similar to FIG. 1, but showing another embodiment of a vehicle's pumping operations at a third well site.
Figure 5:
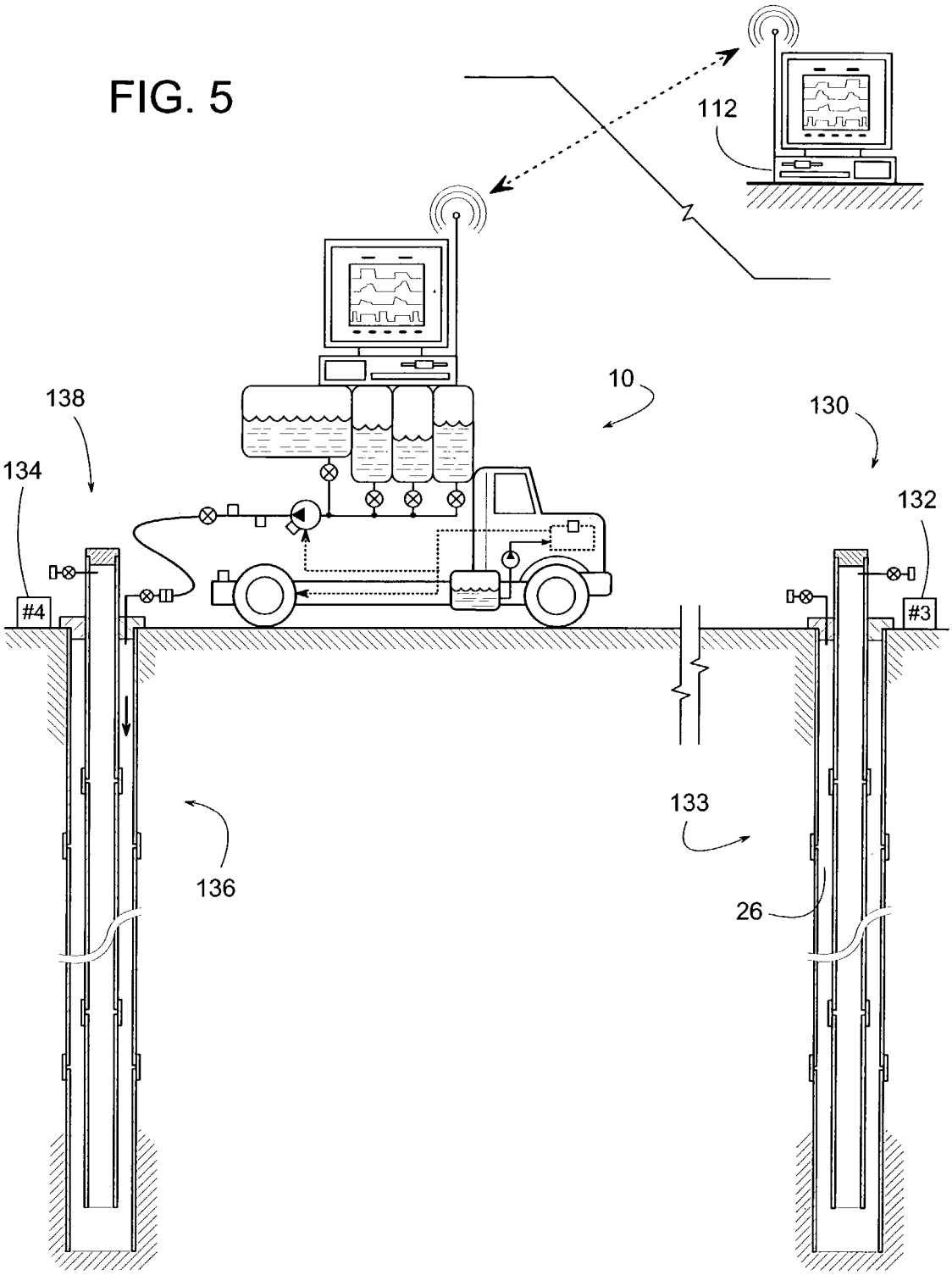
FIG. 5 is similar to FIG. 4, but showing the vehicle pumping fluid at a fourth well site.
Figure 6:
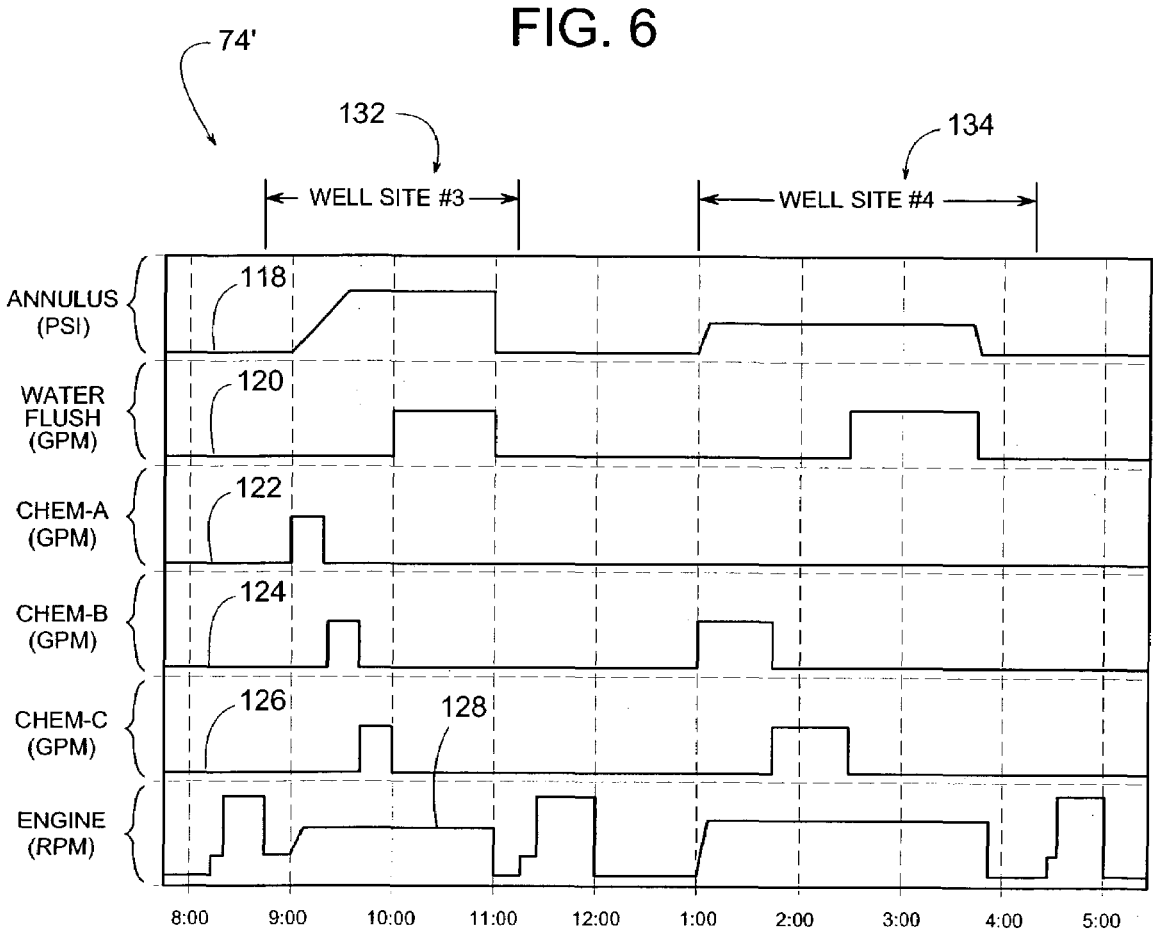
FIG. 6 is a stored data record of digital values that reflect the pumping operations of a vehicle at the well sites of FIGS. 4 and 5.
Figure 7:
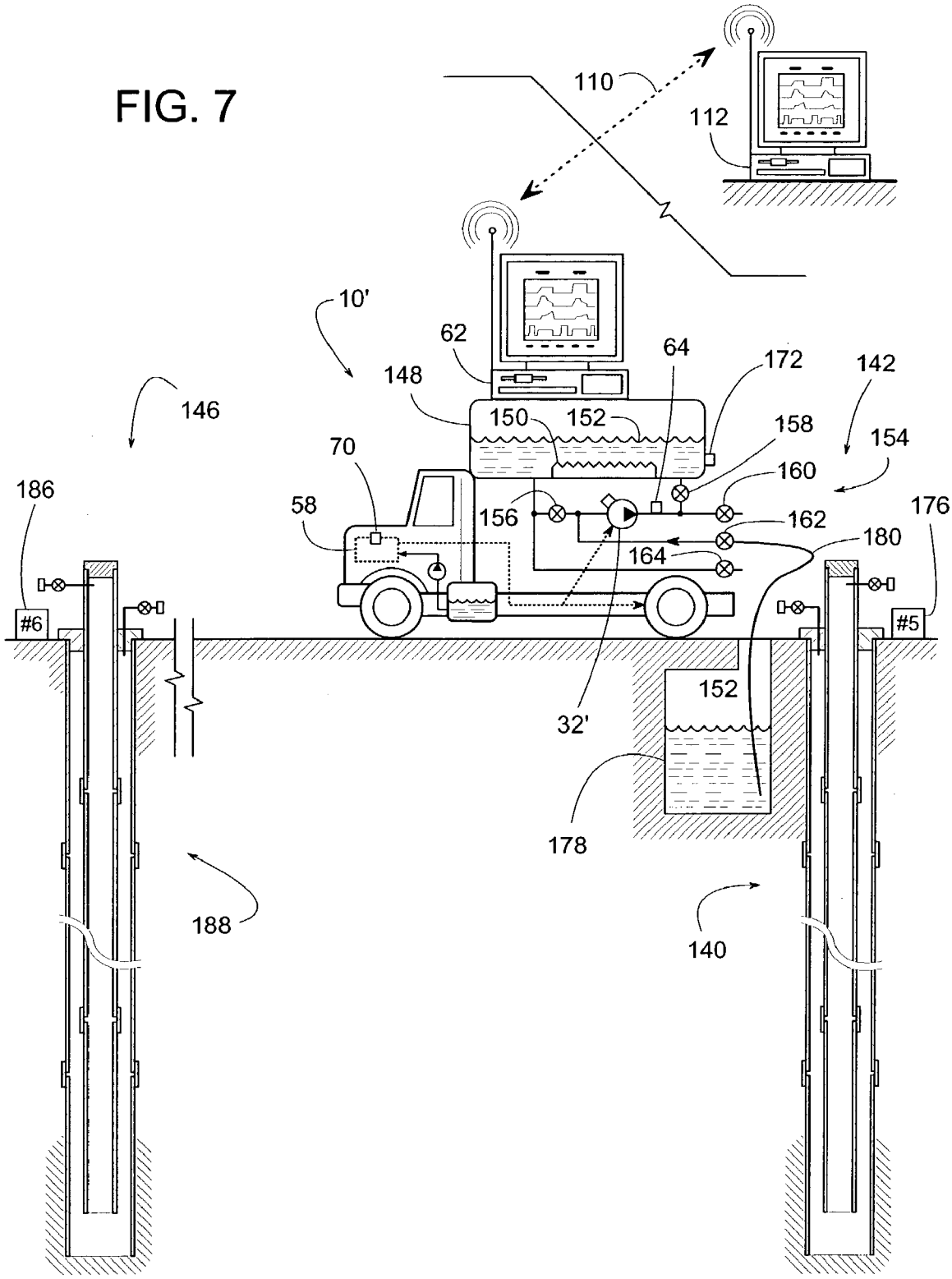
FIG. 7 is a schematic diagram showing a vehicle pumping oil from a tank battery.

In another embodiment, illustrated in FIGS. 4–6, a stored data record 74' comprises a first plot 118 of annulus pressure, as sensed by pressure sensor 68; a second plot 120 of water flush, as measured in GPM by flow meter 66 when valve 39 is open; a third plot 122 for paraffin dispersal 44 (CHEM-A), as measured in GPM by flow meter 66 when valve 43 is open; a fourth plot 124 for scale inhibitor 48 (CHEM-B), as measured in GPM by flow meter 66 when valve 47 is open; a fifth plot 126 for bactericide 52 (CHEM-C), as measured in GPM by flow meter 66 when valve 51 is open; and a sixth plot 128 for engine RPM. Stored data record 74' indicates that vehicle 10 departs the contractor's home base at about 8:30 am and arrives at a well site 130 at about 8:45 am. Upon arrival, a well site identifier 132 identifying well 133 at a well site 130 is entered into data collector 62. Equipment setup, which occurs just before 9:00 am, involves connecting hose 96 from discharge valve 98 to annulus valve 34, as shown in FIG. 4. This allows water and the various chemicals to be selectively and sequentially pumped down into annulus 26.

At 9:00 am, valves 43, 98 and 34 are opened, valves 39, 47 and 51 are closed, and the speed of engine 58 increases to drive pump 32 to pump CHEM-A from tank 42 down through annulus 26. Pumping continues for about twenty minutes, allowing the total amount of CHEM-A to determined by multiplying the GPM reading of flow meter 66 by twenty.

At 9:20 am, valve 43 closes and valve 47 opens to pump CHEM-B from tank 46 down through annulus 26, again for about twenty minutes. Similarly, at 9:40 am valve 47 closes and valve 51 opens to pump CHEM-C from tank 50 down through annulus 26. A water flushing process is performed from 10:00 am to 11:00 am, wherein valve 39 is open and valves 43, 47 and 51 are closed to pump water 40 from tank 38 into annulus 26. The total amounts of water, CHEM-B, and CHEM-C can be determined in the same way as with CHEM-A. In an alternate embodiment, the total volume of water and chemical being pumped is measured directly, and the results are stored and displayed in gallons rather than gallons/minute.

At 11:00 am, the pumping stops and hose 96 is decoupled from annulus valve 34. Stored data record 74' indicates that vehicle 10 is traveling from about 11:30 am to 12:00 am (i.e., from well 133 to well 136), and equipment inactivity from 12:00 am to 1:00 pm indicates a lunch break and/or that equipment is being setup.

When work resumes, a well site identifier 134 identifying another well 136 at another well site 138 is entered into data collector 62. At 1:00 pm, CHEM-B is pumped into well 136, and at 1:40 pm, CHEM-C is pumped into well 136, as shown in FIG. 5. The two chemicals were each pumped into well 136 for twice as long as when pumped into well 133, and so well 136 received twice as much of these chemicals. However, plot 122 indicates that well 136 did not receive any of CHEM-A. Well 136 received a water flush from 2:30 pm till about 3:45 pm. It should be noted that the annulus pressure of well 136 is greater than that of well 133, which may indicate that annulus 26 of well 133 is partially obstructed.

Stored data record 74' indicates that vehicle 10 departs well site 138 at about 4:30 pm and arrives back at the contractor's home base at 5:00 pm. As with the embodiment of FIGS. 1–3, stored data record 74' can be transmitted via wireless communication link 110 from data collector 62 to remote computer 112.

Figure 8:
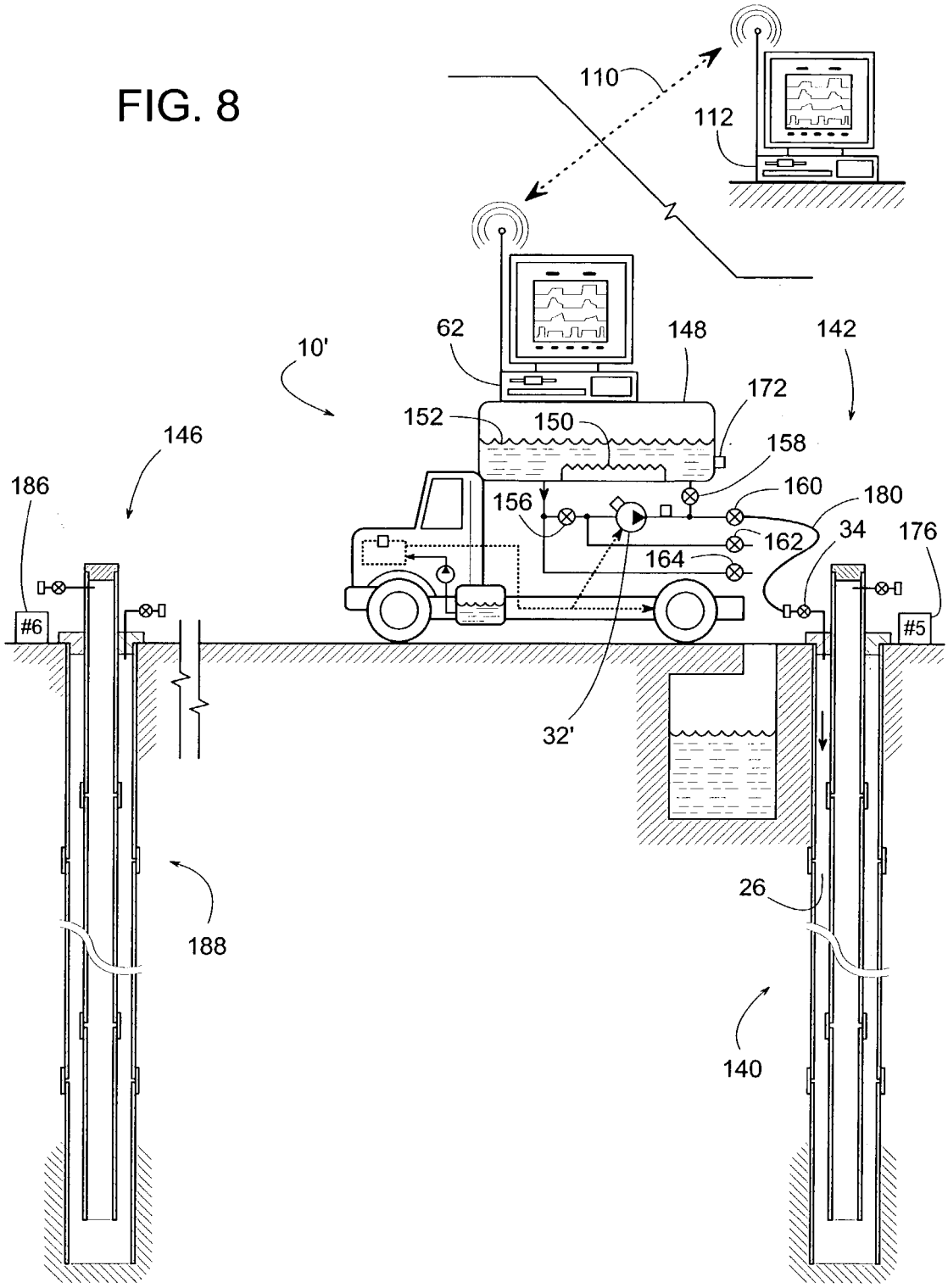
FIG. 8 is a schematic diagram showing the vehicle of FIG. 7 pumping hot oil down into a well at a well site.
Figure 9:
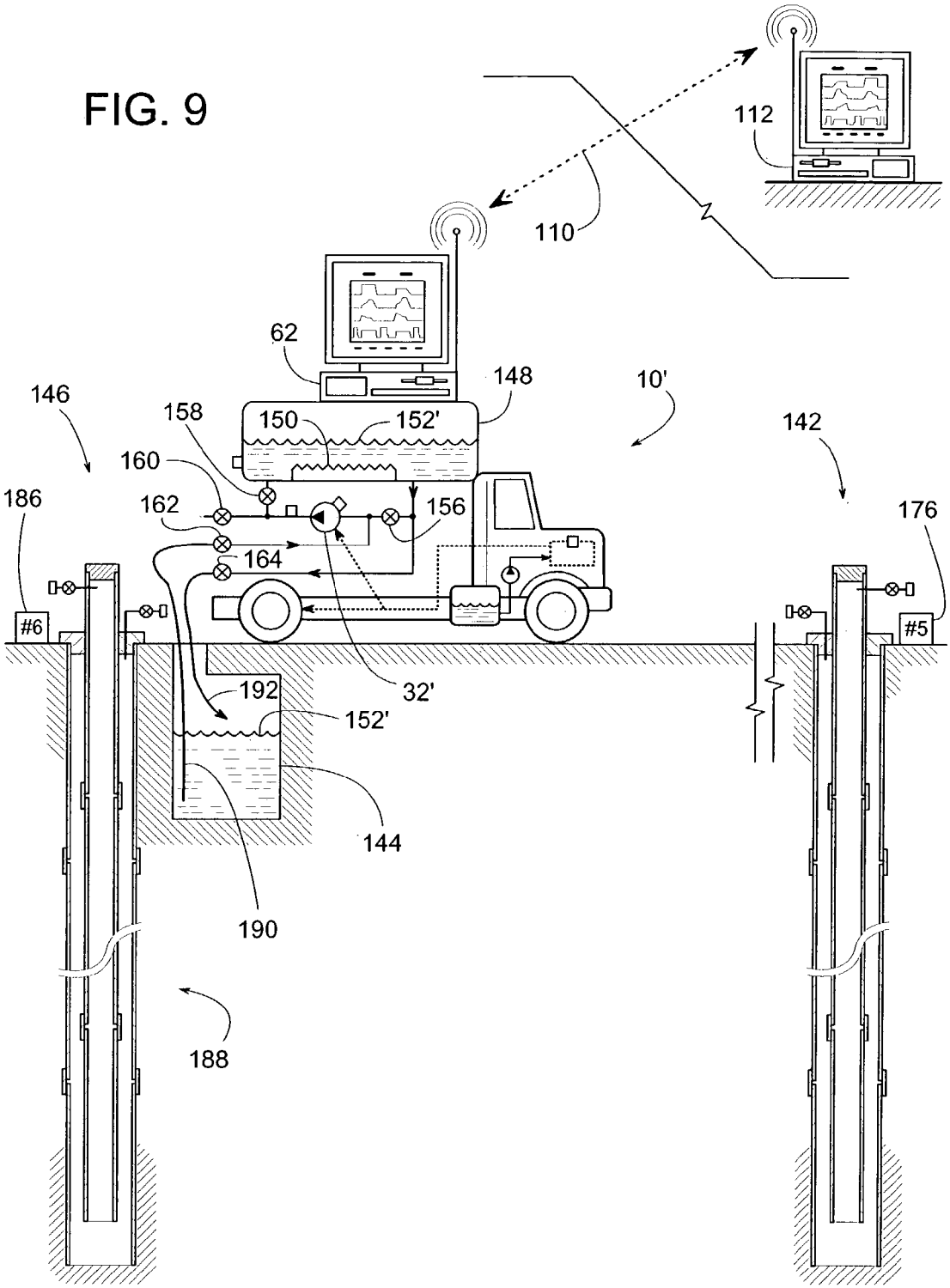
FIG. 9 is a schematic diagram showing the vehicle of FIG. 7 circulating hot oil through a tank battery at another well site.
Figure 10:
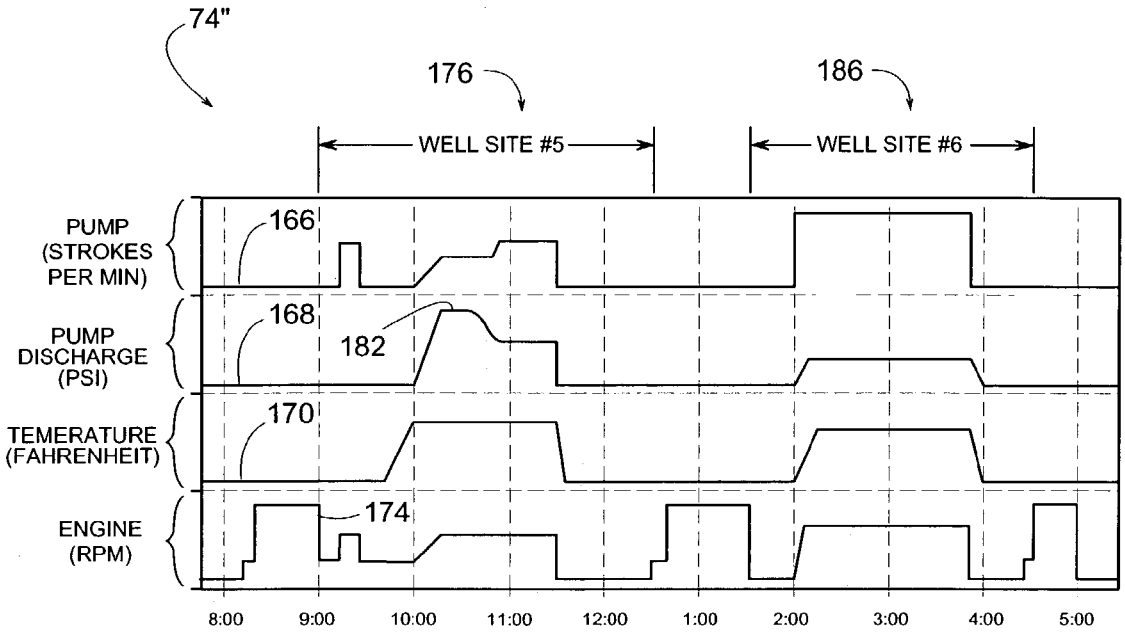
FIG. 10 is a stored data record of digital values that reflect the pumping operations illustrated in FIGS. 7, 8 and 9.

In another embodiment of the invention, shown in FIGS. 7–10, a vehicle 10' provides a hot oil treatment for a well 140 at one well site 142 (FIGS. 7 and 8) and treats a tank battery 144 at another well site 146 (FIG. 9). Vehicle 10' comprises a tank 148 with a heater 150 for storing and heating oil 152. Vehicle 10' also includes a piping system 154 through which oil is directed by valves 156, 158, 160, 162 and 164. FIG. 10 illustrates a stored data record 74" that captures the activities of vehicle 10' throughout a day. Data record 74" includes a first plot 166 of pump strokes/min of a pump 32'; a second plot 168 of pump discharge pressure as sensed by pressure sensor 64; a third plot 170 of oil temperature, as sensed by a temperature sensor 172; and a fifth plot 174 of the speed of engine 58, as sensed by tachometer 70.

Referring to FIG. 10, vehicle 10' drives to well site 142 from 8:15 am to 9:00 am, and a well site identifier 176 is entered into data collector 62. At 9:15 am, pump 32' draws oil 152 from a tank battery 178 (i.e., any vessel above or below ground for holding oil) through a hose connected to valve 162. Valves 164, 160 and 156 are closed, and valves 162 and 158 are open to direct oil in series through hose 80, valve 162, pump 32', valve 158 and into tank 148.

From about 9:30 am to 10:00 am, heater 150 heats oil 152 to a certain temperature, as sensed by temperature sensor 172. In addition, the setup of vehicle 10' is switched over, so hose 180 connects valve 160 to annulus valve 34, as shown in FIG. 8. By 10:00 am, oil 152 reaches the proper temperature, and valves 156, 160 and 34 are opened (valves 162, 164 and 158 are closed) to allow pump 32' to force the heated oil 152 down through annulus 26. This pumping process runs until 11:30 am. A blockage in annulus 26 caused the pump discharge pressure to be relatively high at first, as indicated by an initial hump 182 in plot 168, but the pressure fell after the hot oil dissolved the obstruction.

From 11:30 am to 12:30 am, vehicle 10' is disconnected from well 140, and the service crew breaks for lunch. At 12:30 am, vehicle 10' departs well site 142, arrives at a well 188 at well site 146 at 1:30 pm, and an appropriate well site identifier 186 is entered into data collector 62.

To provide tank battery 144 with a hot oil treatment, vehicle 10' is setup at well site 146, as shown in FIG. 9. Here, a suction hose 190 runs between valve 162 and oil 152' in tank battery 144, and a return hose 192 extends between valve 164 and tank battery 144. Valves 160 and 56 are closed, and valves 162, 164 and 158 are opened to circulate oil in series through suction hose 190, valve 162, pump 32', valve 158, tank 148, valve 164, and return hose 192. As oil 152' passes through tank 148, heater 150 heats oil 152' to a predetermined temperature. This hot oil circulation process runs from 2:00 pm to about 3:50 pm. It should be noted that plot 168 shows that the pump discharge pressure is significantly lower at 3:00 pm than at 10:30 am, which allows one to conclude that a well was being treated at well site 142 and that a tank battery was being treated at well site 146.

Stored data record 74" indicates that vehicle 10' departs well site 146 at about 4:30 pm and arrives back at the contractor's home base at 5:00 pm. Similar to certain other embodiments of the invention, stored data record 74" can be transmitted via wireless communication link 110 from data collector 62 to remote computer 112.

While it is preferred to store the acquired data record at the data collector 62, this is not strictly necessary. For example, data can come into the data collector 62 on a continuing basis, and can be transmitted to the remote computer 112 in almost real time, which allows owner or contractor to monitor the work as it is being accomplished. If this occurs, the data record can be permanently stored at the remote computer 112 instead of with the data collector 62. In this regard, one skilled in the art will understand that the data record need not be completely taken, then stored, and then transmitted, and accordingly this disclosure's concept of a "stored" data record includes data records even only temporarily stored in the data collector 62 for immediate transmission to the remote computer 112.

Although the invention is described with reference to a preferred embodiment, it should be appreciated by those skilled in the art that various modifications are well within the scope of the invention. For example, the stored data record for pumping fluid into a well or a tank battery could also apply to pump 60 pumping fuel 56 from tank 54 to engine 58, whereby fuel consumption of a vehicle can be monitored. Also, since the vehicles are schematically illustrated, the actual configuration of the vehicles' pumps, tanks, valves, piping, etc. can vary widely and still remain well within the scope of the invention. Therefore, the scope of the invention is to be determined by reference to the claims that follow.

What I claim is:

1. A method of monitoring service operations at a well site comprising:

determining a well site identifier of the well site;

sensing a variable associated with the service operation;

storing on an electrical data storage device a first digital value representative of the well site identifier, and a second digital value representative of the variable associated with a fluid, thereby creating a stored data record; and communicating the stored data record to a remote location relative to the well site.

2. The method of claim 1, further comprising determining a time of day that the service operation is being performed, and storing on the electrical data storage device a third digital value representative of the time of day that the fluid was being pumped.

3. The method of claim 1, wherein a service vehicle performs the service operations.

4. The method of claim 3, wherein the type of service vehicle is selected from the group consisting of a pump truck, a chemical tank truck, a chemical tank trailer, a cement truck, a cement trailer, a hot-oiler tank truck, a hot-oiler tank trailer, and a portable work-over service rig.

5. The method of claim 1, wherein the well site identifier is selected from the group consisting of the well's American Petroleum Institute Number, a textual identifier, a bar code label, data stored on a magnetic strip, data stored on an electromagnetic strip, data stored on an integrated circuit chip, data stored on a memory, and a GPS signal.

6. The method of claim 5, wherein the memory is selected from the group consisting of a hard drive of a computer, a floppy disc, a compact disk, a ZIP dive, an electronic chip, and magnetic tape.

7. The method of claim 1, wherein communicating the stored data to the remote location is carried out through a wireless communication link.

8. The method of claim 1, wherein communicating the stored data to the remote location is carried out through a modem.

9. The method of claim 1, wherein communicating the stored data to the remote location is carried out through a cellular phone.

10. The method of claim 1, farther comprising determining the engine's speed and storing on the electrical data storage device a fourth digital value representative of the engine's speed.

11. A method using a service vehicle for monitoring service operations at a well site, wherein the well site is associated with a well site identifier, comprising:

determining a first value indicative of the well site identifier;

sensing at least one second value associated with the service operation;

creating a data record at the vehicle comprising the first value and the at least one second value;

electronically communicating the data record from the vehicle to a location remote to the well site.

12. The method of claim 11, wherein the data record comprises the second value varying as a function of time.

13. The method of claim 11, wherein the service vehicle is selected from the group consisting of a pump truck, a chemical tank truck, a chemical tank trailer, a cement truck, a cement trailer, a hot-oiler tank truck, a hot-oiler tank trailer, and a portable work-over service rig.

14. The method of claim 11, wherein the first value comprises GPS data.

15. The method of claim 11, wherein the first value is embodied at the well site in a media selected from the group consisting of a bar code, a magnetic strip, an electromagnetic strip, an integrated circuit chip, and data stored on a memory.

16. The method of claim 11, wherein determining the first value comprises use of a GPS device associated with the service vehicle.

17. The method of claim 16, wherein determining the first value comprises correlating GPS data to the well site identifier.

18. The method of claim 11, wherein the first value is determined using GPS data.

19. The method of claim 1l, wherein electronically communicating the data record from the service vehicle to a location remote to the well site comprises a wireless communication link.

20. The method of claim 11, wherein electronically communicating the data record from the service vehicle to a location remote to the well site comprises use of a modem.

21. The method of claim 1l, wherein the at least one variable is selected from the group consisting of the speed of an engine of the service vehicle, well tubing pressure, annulus pressure, pump pressure, and fluid flow rate.

22. The method of claim 11, wherein determining the first value comprises an automated process that occurs when the service vehicle approaches the well site.

* * * * *

UNITED STATES PATENT AND TRADEMARK OFFICE

CERTIFICATE OF CORRECTION

PATENT NO. : 7,064,677 B2
APPLICATION NO. : 10/440633
DATED : June 20, 2006
INVENTOR(S) : Frederic M. Newman It is certified that error appears in the above-identified patent and that said Letters Patent is hereby corrected as shown below:

Col 9 line 47 the word farther should be changed to further

Signed and Sealed this

Twenty-second Day of August, 2006

JON W. DUDAS
*Director of the United States Patent and Trademark Office*